US012734410B1

(12) United States Patent
Schulman

(10) Patent No.: US 12,734,410 B1
(45) Date of Patent: Sep. 15, 2026

(54) AQUATIC SOCK AND METHOD OF MANUFACTURING SAME

(71) Applicant: Glenn Schulman, Santa Barbara, CA (US)

(72) Inventor: Glenn Schulman, Santa Barbara, CA (US)

(73) Assignee: Glenn Schulman, Santa Barbara, CA (US)

( * ) Notice: Subject to any disclaimer, the term of this patent is extended or adjusted under 35 U.S.C. 154(b) by 0 days.

(21) Appl. No.: 19/293,534

(22) Filed: Aug. 7, 2025

Related U.S. Application Data

(63) Continuation-in-part of application No. 19/237,638, filed on Jun. 13, 2025.

(60) Provisional application No. 63/808,223, filed on May 19, 2025.

(51) Int. Cl.
*A63B 31/11* (2006.01)

(52) U.S. Cl.
CPC ..... *A63B 31/11* (2013.01)

(58) Field of Classification Search
CPC ..... A63B 31/11
See application file for complete search history.

(56) References Cited

U.S. PATENT DOCUMENTS 5,266,062 A * 11/1993 Runckel ..... A63B 31/11 36/8.1
7,828,615 B2 * 11/2010 Bonis ..... A63B 31/11 441/64

* cited by examiner

*Primary Examiner* — Anthony D Wiest

(57) ABSTRACT

A sock includes a sock portion, a fin portion, and a midsole structure. The sock portion defines a main body portion and a front foot portion integrally extending from the main body portion. The front foot portion is configured to accommodate and cover toes of a user's foot. The fin portion defines a toe enclosure section to slidably receive the front foot portion of the sock portion and defines one or more fins extending forwardly and outwardly away from the toe enclosure section. The midsole structure is fixedly coupled to the fin portion and defining a surface adhered to an underside surface of the sock portion.

17 Claims, 12 Drawing Sheets

AQUATIC SOCK AND METHOD OF MANUFACTURING SAME

CROSS-REFERENCE RELATED APPLICATIONS

The present application is a continuation-in-part of U.S. Non-Provisional application Ser. No. 19/237,638, filed Jun. 13, 2025, entitled "Aquatic Footwear with Integrated Fin", which claims benefit of and priority to U.S. Provisional Patent Application No. 63/808,223, filed May 19, 2025, each of which are hereby incorporated by reference in its entirety as if fully set forth herein, for all purposes.

TECHNICAL FIELD

The inventive subject matter is directed to aquatic footwear that has an integrated swim fin for enhancing a user's propulsion in water.

BACKGROUND

Conventional swim fins, while effective in enhancing propulsion, often come with several drawbacks that can hinder their overall usability and comfort. These traditional designs typically feature a blade attached to a foot pocket, which can be cumbersome and heavy. The weight of these fins can cause fatigue during extended use, making them less ideal for long swimming sessions or diving expeditions.

The materials used in conventional swim fins include rubber, silicone, and composite plastics. Rubber fins are known for their durability and flexibility, but they can be heavy and sometimes uncomfortable. Silicone fins are softer and more comfortable, but they may lack the rigidity needed for effective propulsion. Composite plastics offer a balance between durability and performance but can still be bulky and difficult to transport.

Comfort is another significant issue with conventional swim fins. Full-foot fins, which cover the entire foot, can be particularly problematic if they do not fit perfectly, causing pressure points and reducing the enjoyment of the aquatic experience. Open-heel fins, although adjustable, can still pose comfort issues, especially when used over booties that may not provide adequate cushioning.

Moreover, the clunkiness of traditional swim fins cannot be overlooked. Their bulky design makes them difficult to pack and transport, which is a considerable inconvenience for travelers and outdoor enthusiasts. The lack of compactability means that users often have to deal with awkwardly shaped and space-consuming gear, detracting from the ease and pleasure of spontaneous aquatic adventures.

SUMMARY

In one aspect of the disclosure, a sock is described. The sock defines a sock portion, a fin portion, and a midsole structure. The sock portion defines a main body portion and a front foot portion integrally extending from the main body portion. The front foot portion is configured to accommodate and cover toes of a user's foot. The fin portion defines a toe enclosure section to slidably receive the front foot portion of the sock portion and defines one or more fins extending forwardly and outwardly away from the toe enclosure section. The midsole structure is fixedly coupled to the fin portion and defines a surface adhered to an underside surface of the sock portion.

In some additional, alternative, or selectively cumulative embodiments, the midsole structure and the fin portion are integrally formed with each other.

In some additional, alternative, or selectively cumulative embodiments, the sock portion is made from one or more layers of supple, pliant, form-fitting material, and the fin portion is made from a relatively rigid and yielding material.

In some additional, alternative, or selectively cumulative embodiments, the fin portion is adhered to the sock portion.

In some additional, alternative, or selectively cumulative embodiments, the main body portion is configured to cover an ankle portion of the user, a bridge portion of the user, and toes of the user, the bridge portion extending between the ankle portion and the toes.

In some additional, alternative, or selectively cumulative embodiments, the sock portion is elastically formfitting and includes a non-cellular rubber.

In some additional, alternative, or selectively cumulative embodiments, a material of the sock portion is selected from a group consisting of neoprene, Lycra, spandex, nylon, polyester, and silicone rubber.

In some additional, alternative, or selectively cumulative embodiments, the fin portion is coupled to the sock portion by co-molding or thermobonding.

In some additional, alternative, or selectively cumulative embodiments, the fin portion is coupled to the sock portion by mechanical means selected from a group consisting of straps, ratchet systems, buckles, Velcro, snap buttons, and zippers.

In some additional, alternative, or selectively cumulative embodiments, wherein the sock portion includes an outsole.

In some additional, alternative, or selectively cumulative embodiments, the sock portion includes a midsole.

In another aspect, a method of manufacturing an aquatic sock is described. The method includes forming a sock portion from a flexible and/or a stretchable material. The sock portion is configured to cover a foot of a user. Additionally, the sock portion defines an underside surface. Further, the sock portion defines a main body portion and a front foot portion integrally extending from the main body portion. The front foot portion is configured to accommodate and cover toes of a user's foot. The main body portion is configured to cover an ankle portion of the user, a bridge portion of the user, and toes of the user, the bridge portion extending between the ankle portion and the toes. The method includes forming a finned support structure for the sock portion. The finned support structure includes a fin portion and a midsole structure integrally formed with each other. Further, the method includes inserting a front foot portion of the sock portion into a toe enclosure section of the fin portion and attaching the front foot portion to the toe enclosure section of the fin portion. Moreover, the method includes coupling the underside surface with a receiving surface defined by the midsole structure.

In some additional, alternative, or selectively cumulative embodiments, the midsole structure and the fin portion are integrally formed with each other.

In some additional, alternative, or selectively cumulative embodiments, the sock portion is made from one or more layers of supple, pliant, form-fitting material, and the fin portion is made from a relatively rigid and yielding material.

In some additional, alternative, or selectively cumulative embodiments, the fin portion is adhered to the sock portion by use of adhesives.

In some additional, alternative, or selectively cumulative embodiments, the sock portion is elastically formfitting and includes a non-cellular rubber.

In some additional, alternative, or selectively cumulative embodiments, a material of the sock portion is selected from a group consisting of neoprene, Lycra, spandex, nylon, polyester, and silicone rubber.

In some additional, alternative, or selectively cumulative embodiments, the fin portion is attached to the sock portion by co-molding or thermobonding.

In some additional, alternative, or selectively cumulative embodiments, the fin portion is attached to the sock portion by mechanical means selected from a group consisting of straps, ratchet systems, buckles, Velcro, snap buttons, and zippers.

In some additional, alternative, or selectively cumulative embodiments, the sock portion includes an outsole and a midsole.

BRIEF DESCRIPTION OF THE DRAWINGS

The appended figures show embodiments according to the inventive subject matter, unless noted to be otherwise.

DETAILED DESCRIPTION

Figure 1:
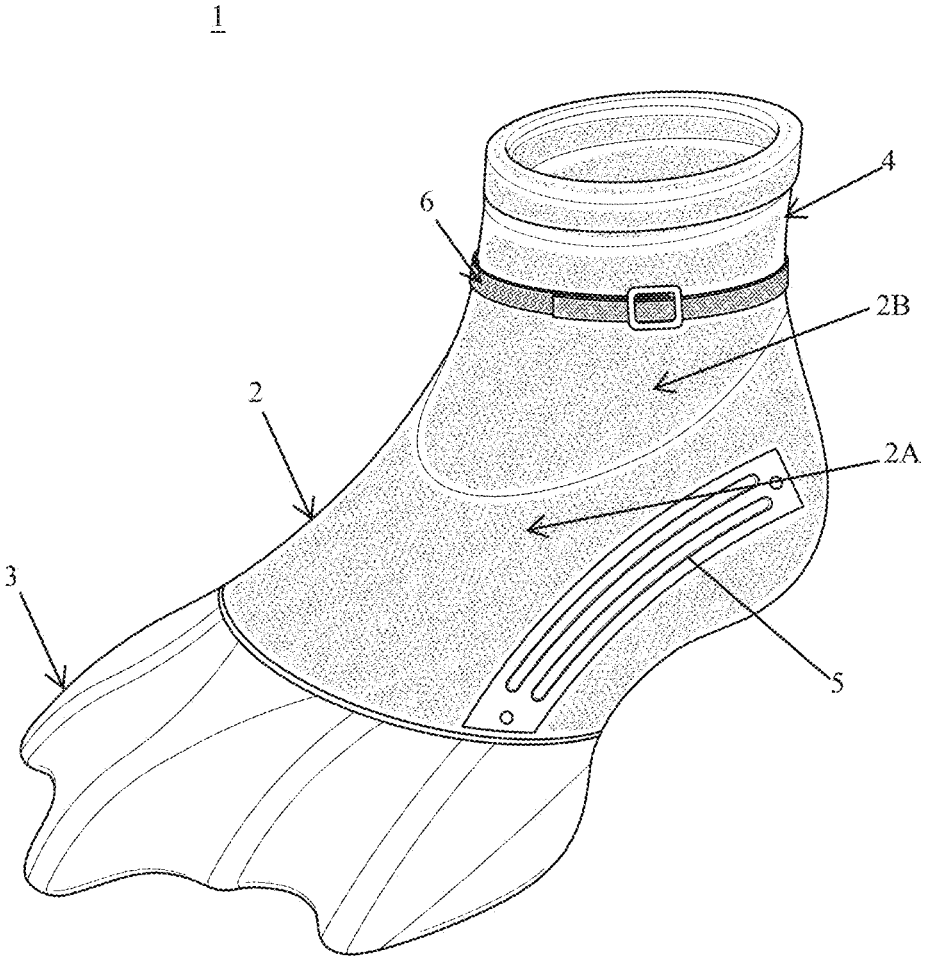
FIG. 1 shows a front perspective view of a first embodiment of aquatic footwear.

Representative embodiments according to the inventive subject matter are shown in FIGS. 1-10. As used herein, a "user" or "wearer" is the person for whom a garment is sized and shaped to fit. For example, if the sock portion is a standard US size 8, it is intended for someone with a size US 8 foot and shoe of size 8. Anatomical references to areas of the aquatic footwear are intended to generally correspond to or mimic areas of the intended user's anatomy. For example, a forefoot region or portion of the footwear maps to the forefoot area of the intended user's foot; an arch region or portion maps to the arch of the intended user's foot; a calf region or portion maps to a calf area of the intended wearer's calf and so forth.

Aquatic footwear according to the inventive subject matter includes a foot enclosure portion that is integrated with a forward fin portion configured to apply propulsive forces when on the foot of a user. The fin may be used in various aquatic activities including swimming, diving, water fitness, and body boarding.

The foot enclosure portion is designed to conform to the anatomy of the foot and optionally the lower leg, providing a snug and comfortable fit. It may be made from one or more layers of supple, pliant, form-fitting material that may be elastic to enhance comfort and adaptability. Suitable materials for the foot enclosure include various textiles and non-textiles such as silicone rubber, elastane fabrics like Lycra and Spandex, nylon, polyester, silicone rubber, neoprene, and blends thereof. These materials may be selected for their ability to stretch and conform to the user's foot, to help ensure a secure fit that is light weight. To be clear, in certain embodiments, the foot enclosure is intended to be sock-like and not like a rigid foot enclosure of conventional swim fins. However, in other embodiments, the fin portion may be configured to receive a user's toes or forefoot, with the remaining areas of the foot being in the foot enclosure portion. As used herein, "foot enclosure portion" means an enclosure that covers foot anatomy as well as lower leg anatomy from the ankle to shins or calf areas of a user, i.e., any anatomy from the ankles to the knee.

The foot enclosure may also feature reinforced areas to provide additional support and durability. These methods include the following options.

Overlay Reinforcements: Thin layers of synthetic materials, such as TPU (thermoplastic polyurethane) or PU (polyurethane), can be applied to high-stress areas of the foot enclosure. These overlays provide additional support and durability without significantly increasing weight Stitching Patterns: Strategic stitching patterns can be used to reinforce the foot enclosure. For example, zigzag or cross-stitching can enhance the structural integrity of the material while maintaining flexibility.

Bonded Reinforcements: Bonding techniques, such as heat-sealing or adhesive bonding, can be used to attach reinforcement materials to the foot enclosure. This method helps ensure a strong bond and can be applied to specific areas that require extra support.

Internal Support Structures: Incorporating internal support structures, such as lightweight frames or mesh inserts, can provide additional stability to the foot enclosure. These structures help distribute the forces generated by the fin more evenly, reducing the likelihood of shifting.

In some embodiments, the reinforcement may be elongate elements like tensile fibers, cables, bands or straps that interconnect the fin portion with the foot enclosure portion. Such fibers can be molded into one of both portions so that they are encased. By affixing such tensile elements from the relatively rigid fin portion to a more flexible foot enclosure portion, the two portions are structurally interconnected and foot enclosure portion may be stabilized on the foot during the propulsive forces generated by the fin portion. The tensile elements would have a tensile strength that is greater than that of the general body of the foot enclosure. They may have a tensile strength that is 10%, 20%, 30%, 40%, 50%, 60%, 70%, 80%, 90%, 100%, 150%, 200%, 300%, 400% or more than the foot enclosure.

Figure 8:
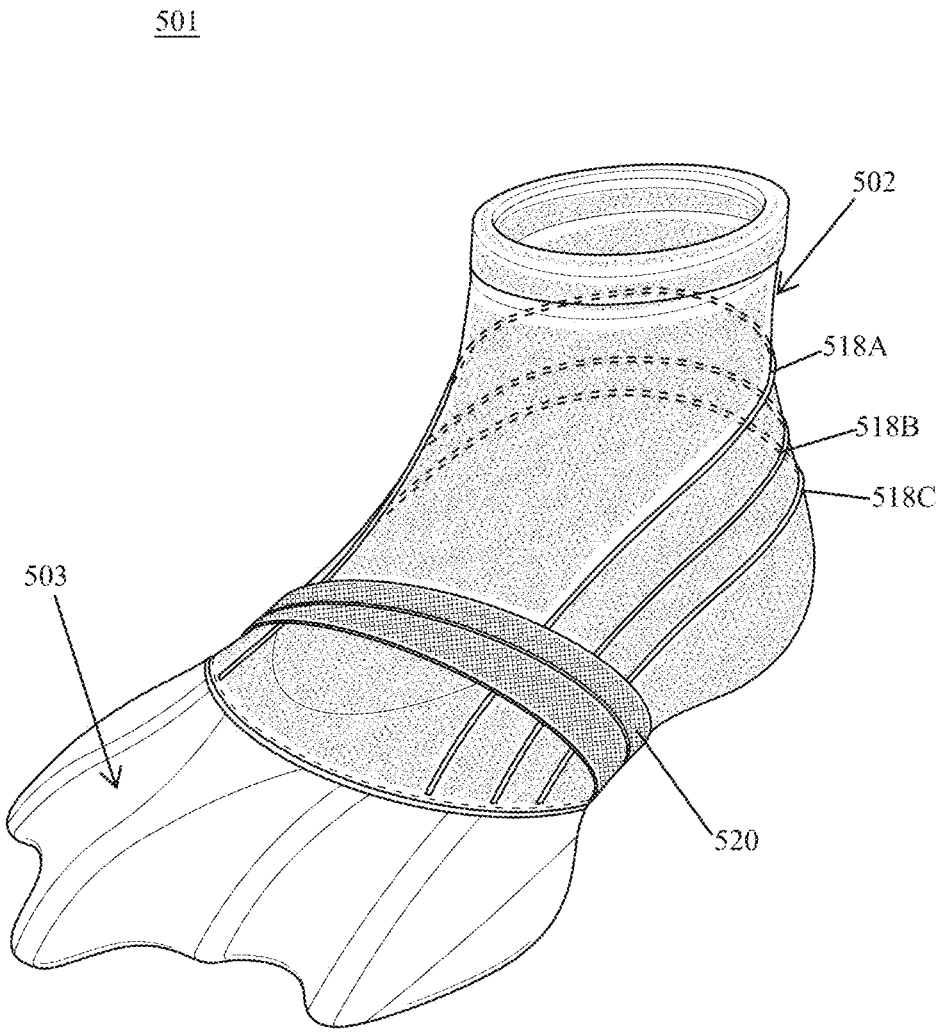
FIG. 8 shows a front perspective view of a sixth embodiment of aquatic footwear.

The tensile elements may be oriented along the longitudinal axis of the fin portion and the foot enclosure portion. They may also be oriented along a perpendicular or transverse axis or along both axes. FIG. 8 shows an example of tensile elements oriented longitudinal and transversely. The tensile elements may extend partially along an axis or fully. They may loop around the foot along any axis. For instance, as seen in FIG. 8, the longitudinal tensile elements loop around the heel and return to a front region of the footwear. The transverse elements do not loop under the foot but in other embodiments they could.

There may be multiple tensile elements in any direction, as seen, for example, in FIG. 8. For example, there may be 2, 3, 4, 5, 6, 7, 8, 9, 10 or more tensile elements spaced apart and generally parallel to each other in a given direction. The tensile element can extend 10%, 20%, 30%, 40%, 50%, 60%, 70%, 80%, 90%, 100% of the length and/or width of the foot enclosure portion.

Suitable tensile elements include the following. Fishing line, particularly nylon and ultra-high-molecular-weight polyethylene (UHMWPE), offers high tensile strength and flexibility. Kevlar cables are high-strength synthetic fiber known for their durability and resistance to stretching. Vectran or other high-strength synthetic fibers. Vectran is a high-performance fiber made from a liquid-crystal polymer (LCP). Chemically, it is an aromatic polyester. Dyneema fiber is another option. It is ultra-high-molecular-weight polyethylene fiber known for its exceptional strength-to-weight ratio. Thermoplastic polyurethane (TPU) straps are flexible yet strong and are therefore suitable. Carbon fiber is known for its high tensile strength and lightweight properties. Thin carbon fiber inserts can be embedded in the footwear to provide additional support and rigidity without compromising flexibility. Nylon webbing is another suitable option. It is strong, lightweight, and resistant to abrasion. Elastic bands made from materials like spandex or Lycra can be embedded in the shoe upper to provide dynamic support. These bands can be selected to balance a need for stabilization with some stretchability. This would allow for the foot enclosure to contract with the foot's movement, offering a snug fit but still maintaining support during various activities. Such bands could be selected so that they are relatively less elastic than the foot enclosure portion.

While the foregoing description is focused on a sock-like foot enclosure, in some embodiments related to fin configurations disclosed herein, it will be appreciated that the fin configurations can be applied to any kind of foot enclosure, including foot enclosures that are part of conventional shoe construction that includes an outsole or outsole and midsole, or in a foot enclosure for a conventional fin. FIG. 2 shows an example of an item of aquatic footwear that include an outsole and/or an outsole and midsole. It otherwise is a sock-like foot enclosure like the embodiment of FIG. 1.

The fin portion may be made from a rigid or semi-rigid material and is configured into a shape and surface area that effects propulsion. While the fin could be completely rigid like a paddle, the material is typically configured into a fin that will have some flex during use. In other words, it may be like conventional swim or diving fins in terms of configuration, materials, and rigidity.

The fin portion of diving flippers and swim fins requires materials that offer a balance between strength, flexibility, and weight to optimize propulsion. Thermoplastic polyurethane (TPU) is particularly suitable for this purpose as it provides durability and adaptability, making it ideal for creating fins that respond well to movement in water. Polyurethane (PU) is another material that is often utilized due to its rigidity and strength, which ensures effective propulsion. For applications demanding high performance, carbon fiber stands out with its lightweight and exceptional tensile strength, significantly enhancing the efficiency of the fin portion. Ultra-high-molecular-weight polyethylene (UHMWPE) offers a suitable strength-to-weight ratio, making it a good choice for fin portion. Silicone rubber, while flexible and resilient, may also be suitable.

The fin portion serves to effectively increase the surface area of the user's foot. It can do this by extending around any portion of a user's foot, namely the front, sides, and/or rear foot regions. However, typically the fin portion extends from at least the front of the toe or forefoot area of the foot enclosure. The width of the fin can vary, allowing it to be as wide as the foot or wider than the foot for increased surface area and propulsion. The fin may include portions that extend along one or both sides of a user's foot, as seen in the embodiments disclosed herein. The fin portion can be positioned entirely in front of the toes, or it can extend along and outwardly from some or all of one or both sides of the wearer's foot with a forefoot portion of the foot in an enclosure defined by fin material. Generally, such a structure would be (but not necessarily is) a unitary structure with the foot enclosure portion and part of a single, molded unit. In other possible embodiments, the fin portion extends laterally from the foot and not substantially in front of the end of the foot (i.e., the toe tips). A fin portion that does not extend more than 3, 4, or 5 cm in front of the foot may be considered not to extend "substantially" in front of the foot. Instead of extending from the front, it may extend laterally (widthwise) by 3 cm, 4 cm, 5 cm, 6 cm, 7 cm, 8 cm, or 9 cm, or more, from one or both sides of the foot. The length of the lateral extensions along the foot can be at least of similar measures.

To integrate the fin portion with the foot enclosure portion, the fin portion can be coupled to the foot enclosure using various methods, including co-molding, bonding, stitching, and mechanical means. Co-molding as used herein involves integrating the fin portion and foot enclosure portion during a molding process to create a seamless bonding of the portions. This method ensures durability and a secure fit by fusing the materials together as they cool and set. Bonding is an alternative method of joining the portions that uses high-strength adhesives, such as epoxy or polyurethane-based glues, to attach the fin to the foot enclosure securely. Thermal fusion of materials or thermobonding is another form of bonding where materials are fused. Mechanical means of coupling the portions can also be used and involves employing straps, buckles, Velcro, snap connectors, zippers, etc. to attach the fin to the foot enclosure. These methods offer removability and adjustability.

In some embodiments, the fin can be slidable or otherwise repositionable relative to the user's foot, allowing the amount of extension to vary. The Figures (discussed in more detail below) show examples of fins that are repositionable or removable. This feature enables users to adjust the fin for optimal performance based on their needs. For example, in one possible embodiment, the fin portion can slide over the top or bottom of the foot enclosure portion and thereby over a user's foot. By sliding the fin portion rearwardly or forwardly over the foot enclosure, the surface area of the fin portion decreases or increases to vary propulsive force that may be applied. Retraction of the fin portion can make the aquatic footwear more walkable. Similarly, in other embodiments, a fin portion that extends laterally wider that the user's foot could be width adjustable. Widthwise adjustments can be relative to both sides of the foot or selective to a single side. In some embodiments, the fin portion is adjustable lengthwise and widthwise.

In some embodiments, the fin portion is removable for walking or to swap out with another fin portion configuration for different needs. For example, a short fin portion could be used for casual swimming in a pool, and a long fin portion could be used for deeper diving in the ocean. Accordingly, the inventive subject matter contemplates a kit of a footwear enclosure and multiple different swappable fin portions. The foot enclosure can also be in the style of a shoe with a rubber outsole or other durable outsole material on its bottom.

In some embodiments, the fin portion is configured stow alongside the foot for ease of walking. For example, it could fold over the foot, have a pivotable connection, have a removable connection with complementary retention means on the foot enclosure and fin portion for stowing the fin, portion, e.g., hook and loop fasteners, snap connectors, magnets, elastic loops or straps, etc. In other embodiments, it is foldable over the foot enclosure using a living hinge or other hinge mechanism.

To make the fin portion easily repositionable or removable, various mechanisms can be employed. Telescoping means allows the fin portion to extend or retract, enabling users to adjust the length of the fin portion for varying levels of propulsion. Slide tracks incorporated into the design allow the fin portion to move along a predefined path, enabling users to slide the fin portion forward or backward to adjust its position relative to the foot enclosure. Pivot points added to the fin portion attachment, allowing it to rotate or swivel, providing additional flexibility in positioning. Detachable sections of the fin portion can be added or removed to vary the surface area and propulsive force. Any of these means can be disposed on the foot enclosure portion and/or the fin portion to effect repositioning, removability, and/or stowability.

Earlier, tensile elements were discussed as a means for stabilizing a foot enclosure on a user's foot. Other options for preventing a supple foot enclosure material from shifting due to the forces generated by the fin, include use of a shank that interconnects the fin portion and foot enclosure portion. Shanks are elongate rigid structures that extend along the length of the item of footwear. Usually, they extend along the bottom of the footwear but under the inventive subject matter, they can extend rearwardly from the fin portion along the user's foot, covering the top, sides, and/or bottom of the foot. They are configured to provide additional support and stability, helping to ensure that the foot enclosure remains in place and leverage is effectively applied to the fin.

Adjustable straps or other tightening means may be disposed along or around any area of the footwear to help secure the foot enclosing portions to the user's anatomy and help maintain stability and prevent movement. For example, one or more tightening straps that tighten the foot enclosure against the foot or lower leg may be placed anywhere on the foot enclosure, including the forefoot, midfoot, rearfoot, heel, ankle, and/or lower leg areas.

Example Material Selection for Aquatic Footwear:

The aquatic footwear contemplated herein may be constructed from known materials used to make water shoes and swim fins. However, the inventive subject matter contemplates advantageous use of non-cellular and cellular rubbers, particularly combinations of such materials. Silicone rubber is an example of a non-cellular rubber and Neoprene rubber is an example of a cellular rubber.

In some embodiments, the foot-receiving enclosure comprises a hybrid construction utilizing distinct elastomeric materials for different portions of the enclosure. Here follows is a representative example.

A lower portion of the foot enclosure may be formed from a non-cellular elastomer, such as silicone rubber, thermoplastic elastomers (TPE), polyurethane, or polyisoprene. These materials are selected for their high elasticity, moldability, and resistance to environmental degradation. The lower portion may be molded to conform to the user's foot and may optionally integrate with propulsion elements such as fins or molded extensions.

An upper portion of the enclosure may be formed from a cellular elastomer, such as closed-cell neoprene, limestone neoprene, ARIAPRENE®, or Yulex™. These materials are selected for functional aspects such as their thermal insulation, compressibility, and ease of donning and doffing. The cellular structure provides buoyancy and comfort, particularly in cold-water environments.

The lower portion may be an area that is disposed under the ankle area and the upper portion may be an area that covers the ankle area. This hybrid construction enables a balance of functions such as structural integrity, thermal performance, and ergonomic adaptability. The lower molded portion provides a durable, water-resistant seal and conforming fit, while the upper portion facilitates user comfort and flexibility.

In some embodiments, the foot enclosure portion may include gussets, stretch zones, or other features to accommodate variable foot shapes and entry angles. The underside of the foot enclosure portion may have a standard water-shoe outsole attached to it, e.g., an outsole of foamed EVA or PU.

Example Embodiments

Figure 2:
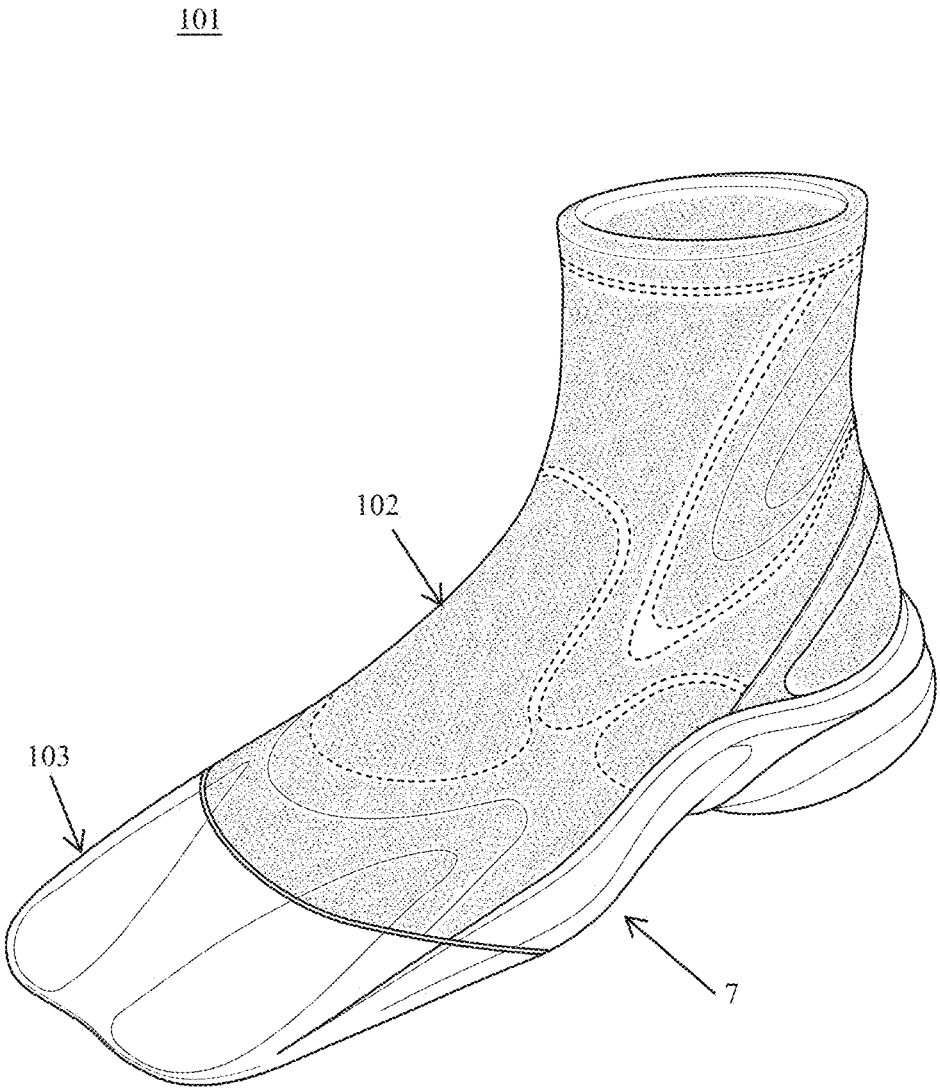
FIG. 2 shows a front perspective view of a second embodiment of aquatic footwear.

Looking at FIGS. 1-10 in detail, FIG. 1 shows an item of aquatic footwear 1 with a foot enclosure portion 2 and a fin portion 3. In this embodiment, the foot enclosure is a supple and pliant material configured to receive at least a majority of a user's foot. However, in some embodiments, the fin portion may receive a front section of the foot, e.g., the toes. The material may be a thin layer of silicone or other layer of rubber. The fin portion includes a toe enclosure and a fin section that extends forwardly of the toes. The fin portion can be molded from any known rubbery or plastic fin material or other suitable materials. The fin portion and foot enclosure portions can be joined using previously discussed techniques. In one possible embodiment, the foot enclosure portion is divided into two or more sections. In the embodiment shown, the enclosure includes lower and upper sections 2A and 2B. The different sections can be of different materials and/or structures to provide different functional benefits. For example, section 2A could be a single ply of silicone or other rubber for a tight conforming fit. Section 2B could be one or more plies of durable material or less elastic material, e.g., Neoprene rubber that provides more structural integrity or allows for easier donning or securing of the footwear to a user's foot.

The embodiment of FIG. 1 shows an optional elongate shank 5 that extends proximally from about a lateral side section of the fin portion 3 corresponding to a metatarsal region of a user's foot and into a lateral side section of the foot enclosure portion 2 corresponding to a user's rearfoot. Although only a single shank is shown, it is understood that multiple shanks may be used. In some embodiments for a removable fin, the shank could slide and lock into receivers disposed on the foot enclosure portion (not shown).

In the embodiments shown, the footwear includes a lower leg portion 4 that extends above the user's ankles in a high-top configuration. In other embodiments, the foot enclosure may be a low-top configuration that does not rise above the user's ankle.

The embodiment of FIG. 1 shows an optional strap and buckle system 6 for better securing of the foot enclosure portion to a user's foot or lower leg.

The fin portion 3 of aquatic footwear 1 extends substantially wider than and forward of the user's foot. In contrast, the embodiment of aquatic footwear 101 in FIG. 2 has foot enclosure portion 102 and a fin portion 103 more closely conform to a user's foot like a standard shoe would fit. For example, forward and lateral portions of the fin do not extend more than 5 cm, 4 cm, 3 cm, 2 cm from the front and or sides of the intended user's foot when the foot is placed in the aquatic footwear. In this embodiment, the fin portion would include an area for housing at least a portion of the user's front foot.

Looking more at the embodiment of FIG. 2, it includes an outsole or outsole and midsole structure 7.

Figure 3:
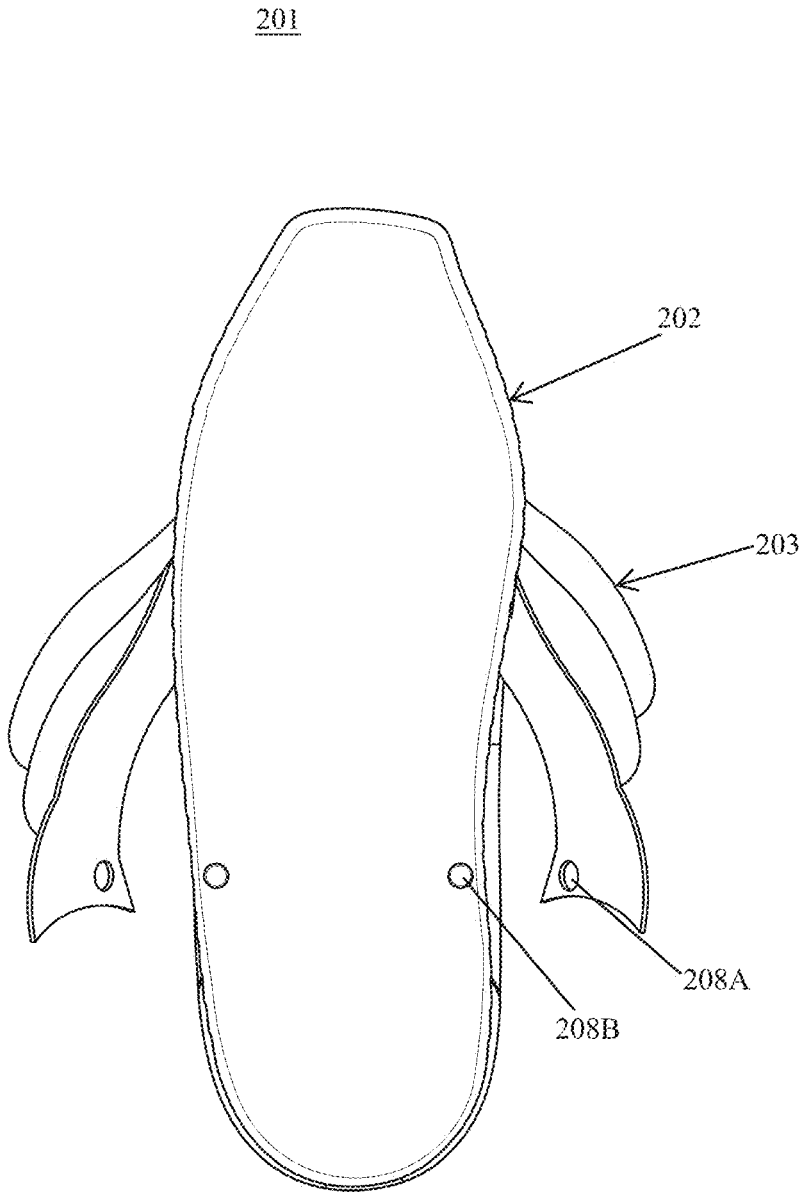
FIG. 3 shows a bottom view a third embodiment of aquatic footwear.

FIG. 3 shows an alternative embodiment of aquatic footwear 201 including a foot enclosure portion 202, where the foot enclosure portion 202 is configured with a fin that is repositionable. The fin is coupled to the front of a foot enclosure. It has rearwardly extending lateral sections that are deployed along each side of the foot enclosure. Those sections are sufficiently flexible or hingeable at the front of the foot enclosure so that they can be collapsed along the sides of the foot enclosure. The foot enclosure and fin sections have complementary securing means 208A, 208B for securing the sections against the foot enclosure. For example, the securing means could be snaps/holes or buttons/holes.

Figure 4:
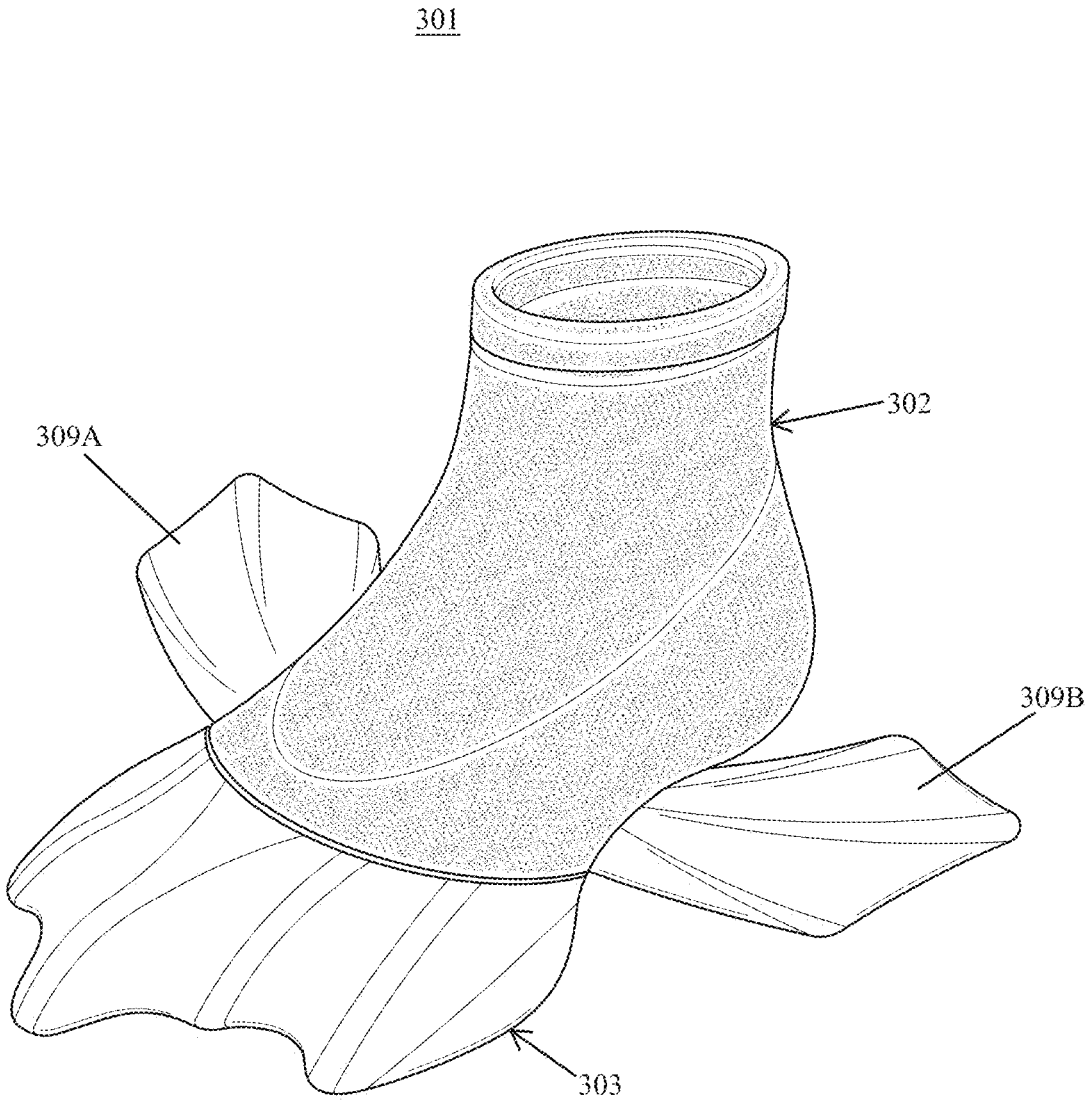
FIG. 4 shows a front perspective view of a fourth embodiment of aquatic footwear.

FIG. 4 shows an embodiment of aquatic footwear 301 including a foot enclosure portion 302 and a fin portion 303 similar to that of FIG. 1 but with side-fin portions 309A, 309B extending laterally from midfoot sections of the footwear.

Figure 5A:
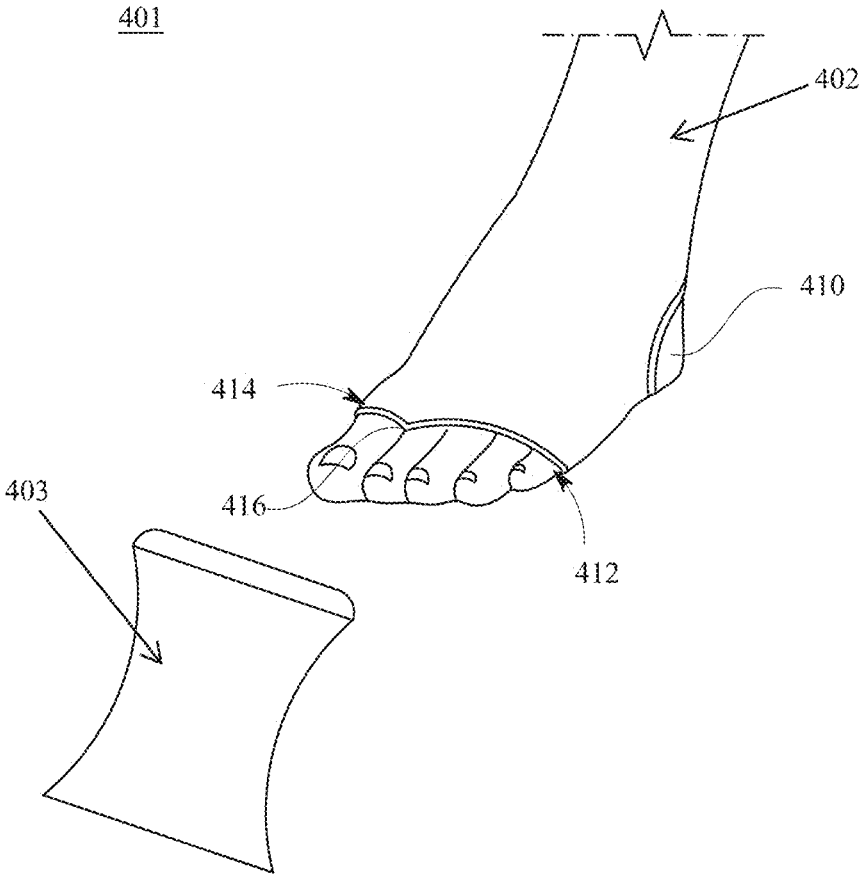
FIG. 5A shows front perspective view of fifth embodiment of aquatic footwear with a removable fin portion in a removed condition.
Figure 5B:
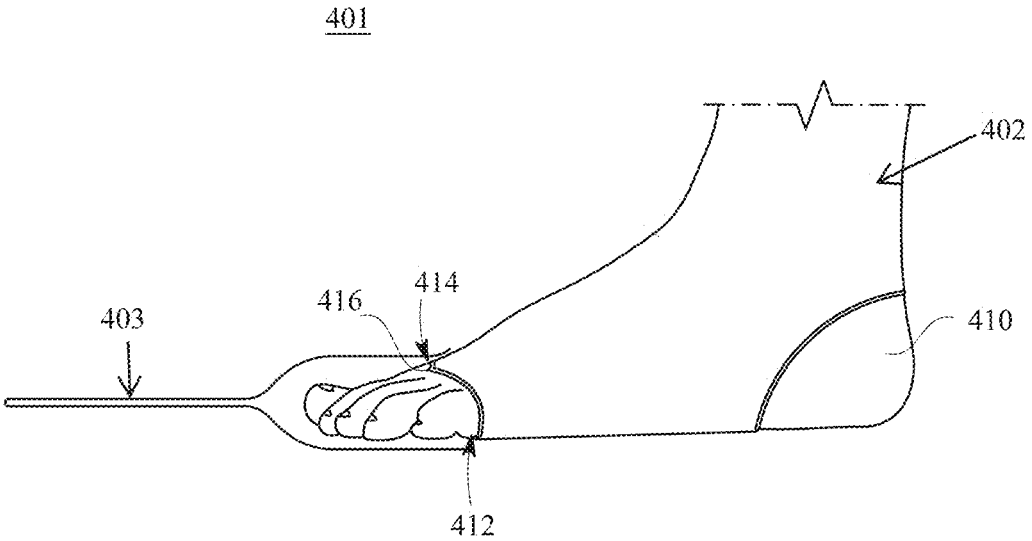
FIG. 5B shows a side view of the embodiment of FIG. 5A with the fin attached, the fin portion being shown as a sectional view.

Looking at the embodiment of aquatic footwear 401 of FIG. 5A-5B, the foot enclosure portion may include an open heel area 410 and open toe area 412. The user's toes extend into the fin enclosure through aperture 412 at the ball of foot area 414. The opening is defined by a front edge 416.

FIGS. 5A-B show an example of a fin portion 403 that removably couples to a foot enclosure 402. Although not shown, the fin portion could include one or more elongate, rearwardly extending rigid or semi-rigid shanks or tangs that slidably couple with receivers disposed on or in the foot enclosure portion. Shank 5 from FIG. 1 could be adapted to be not only a shank but also a coupling structure. An advantage of such structures is they stabilize the foot enclosure against the forces encountered during use. The tang or shanks may include ridged surfaces for coupling with a complementary ratchet mechanism. Not only would such a coupling system allow for removability, but it would also allow for adjustability in terms of sizing or length of fin extension. In addition to a rachet coupling, coupling could be attained by other means including clamps, screws, buckles, etc. In some embodiments, instead of shanks or tangs, flexible straps could be used.

Figure 6:
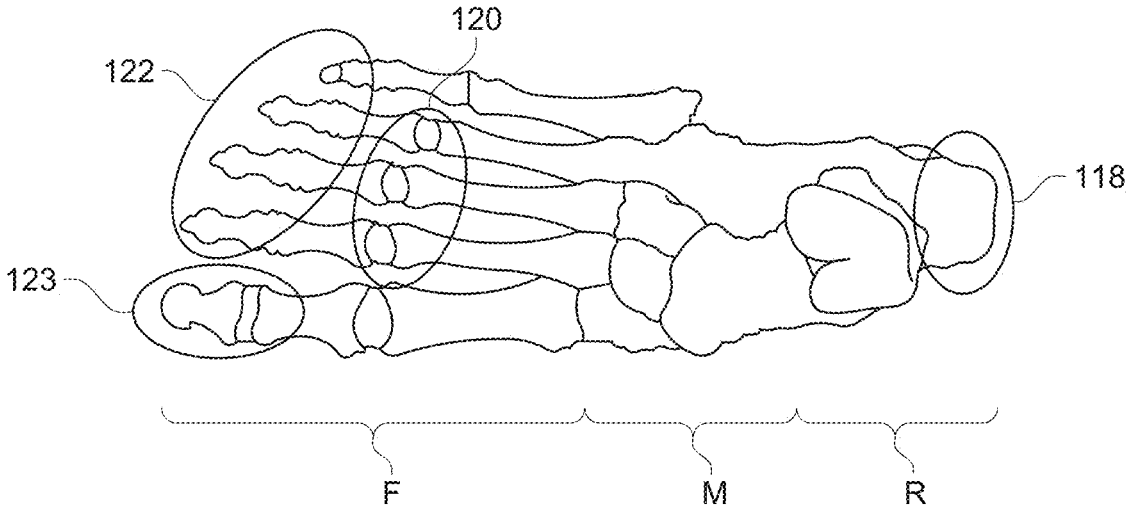
FIG. 6 is a top view of the bones of a representative human foot.

FIG. 6, which is discussed in more detail below, shows the bones of the foot and ankle to give light to anatomy being discussed.

Figure 7:
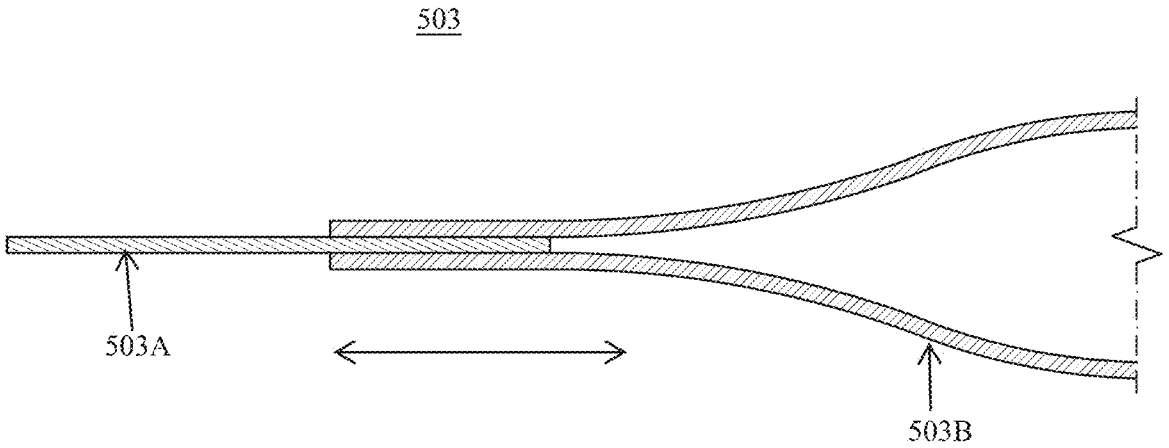
FIG. 7 shows a side sectional view of a fin portion for aquatic footwear.

FIG. 7 shows an embodiment of a fin portion 503 that has adjustable length and thereby adjustable surface area. The fin portion includes an inner telescopically slidable section 503A slidably disposed in an outer fin portion 503B. In other embodiments that slidable portions can be disposed in an over/under arrangement rather than one section telescoping from within another. Although not shown, the system would include an adjustment mechanism for structurally coupling the fin and foot enclosure portions. E.g., a set of complementary straps/buckles, pins/receivers, snap fittings, etc.

FIG. 8 shows an embodiment of aquatic footwear 501 with reinforcement structures. That structures may be embedded within the material of the foot enclosure, e.g., molded into material, captured between plies of material or attached to inner or outer surfaces of the foot enclosure. In this example, tensile cables 518A, 518B, 518C, extend proximally from the fin portion 503 and through or against foot enclosure 502. They are generally spaced apart and parallel and follow the sides of the foot and wrap around the heel and return to the fin portion along the opposite side of the footwear.

Footwear 501 may also include a forefoot or midfoot band 520 that partially or fully encircles to foot. The band can be inelastic and may include adjustment means (not shown) like buckles, clamps, ratchet mechanisms, etc. Or it could be partially elastic so that it yields substantially less than the general enclosure portion 502.

Figure 9:
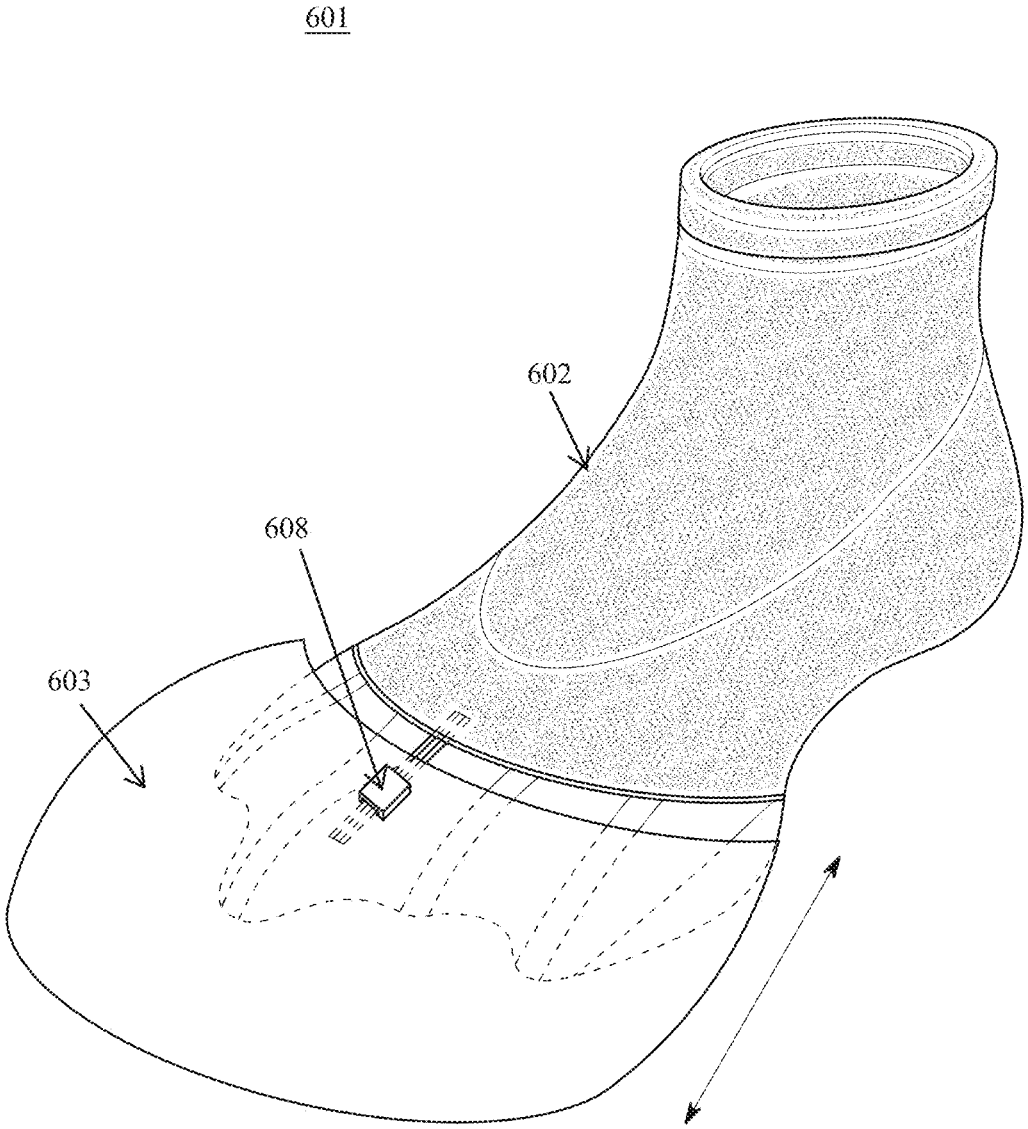
FIG. 9 shows a front perspective view of a seventh embodiment of aquatic footwear having a repositionable or removable fin portion.

FIG. 9 shows an embodiment of aquatic footwear 601 having a fin portion 603 that is slidable over a foot enclosure portion 602 and which can be locked into selected position using an adjustment mechanism 608, e.g., a groove/pin or track system or as contemplated for the embodiment of FIG. 7 or elsewhere in this disclosure.

Figure 10:
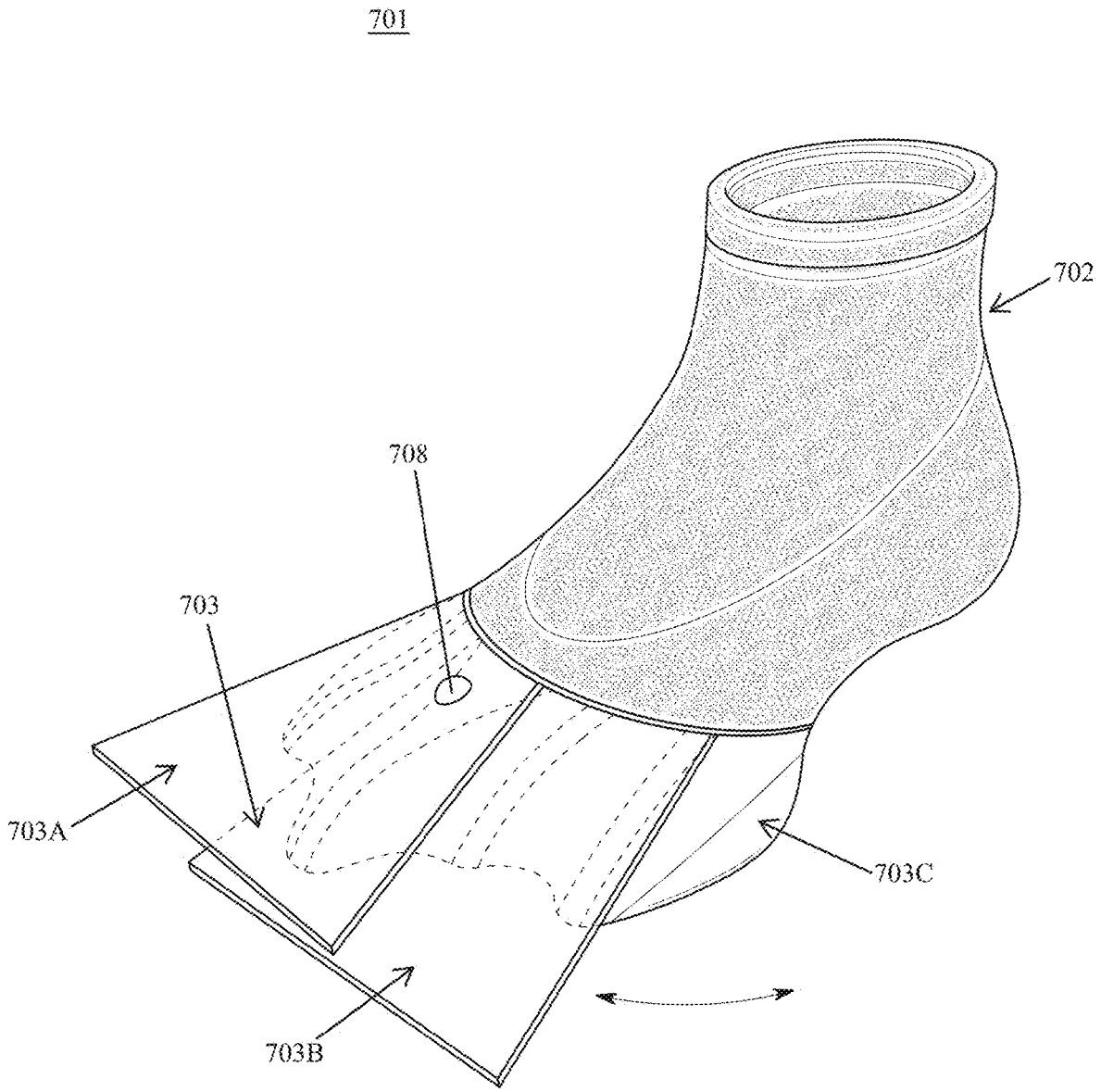
FIG. 10 shows a front perspective view of an eighth embodiment of aquatic footwear having a repositionable or removable fin portion.

FIG. 10 shows an embodiment of aquatic footwear 701 including foot enclosure portion 702 having 0061n adjustable fin portion 703 that can be adjusted widthwise for permanent or removable coupling to a foot enclosure. The system includes two fin portions 703A, 703B that overlie a main fin portion 703C. The overlying fin portions can fan in and out to vary the width and hence the surface area of the overall fin assembly. The overlying fin portions may also be removable so that a user can just use the main fin portion or to swap in different fin configurations. The fin portion may include an adjustment mechanism 708 allowing for fixing or repositioning or removing fin portions. The adjustment mechanism can be a clamping screw and threaded receiver or other an adjustment mechanism as contemplated for other embodiments discussed earlier.

Figure 11:
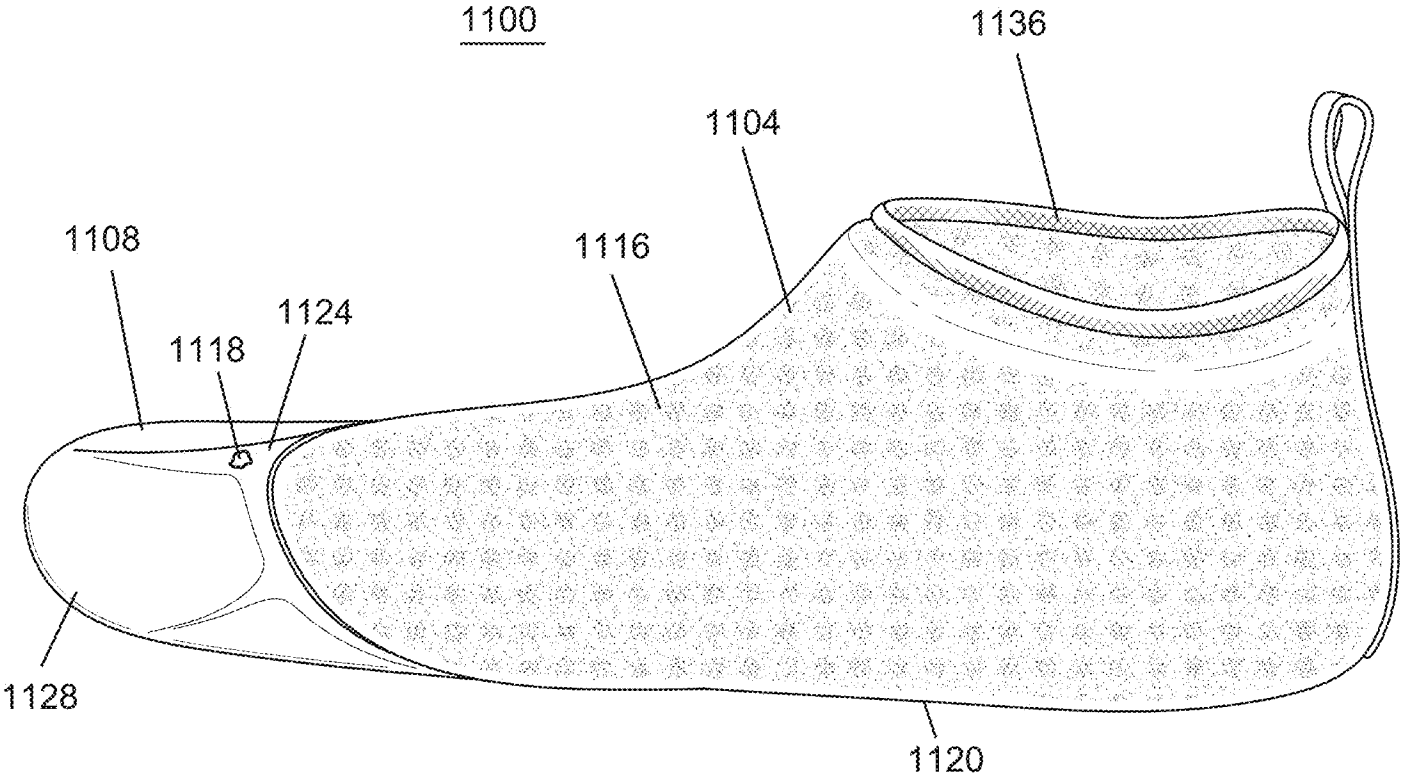
FIG. 11 shows a side view of an aquatic sock.
Figure 12:
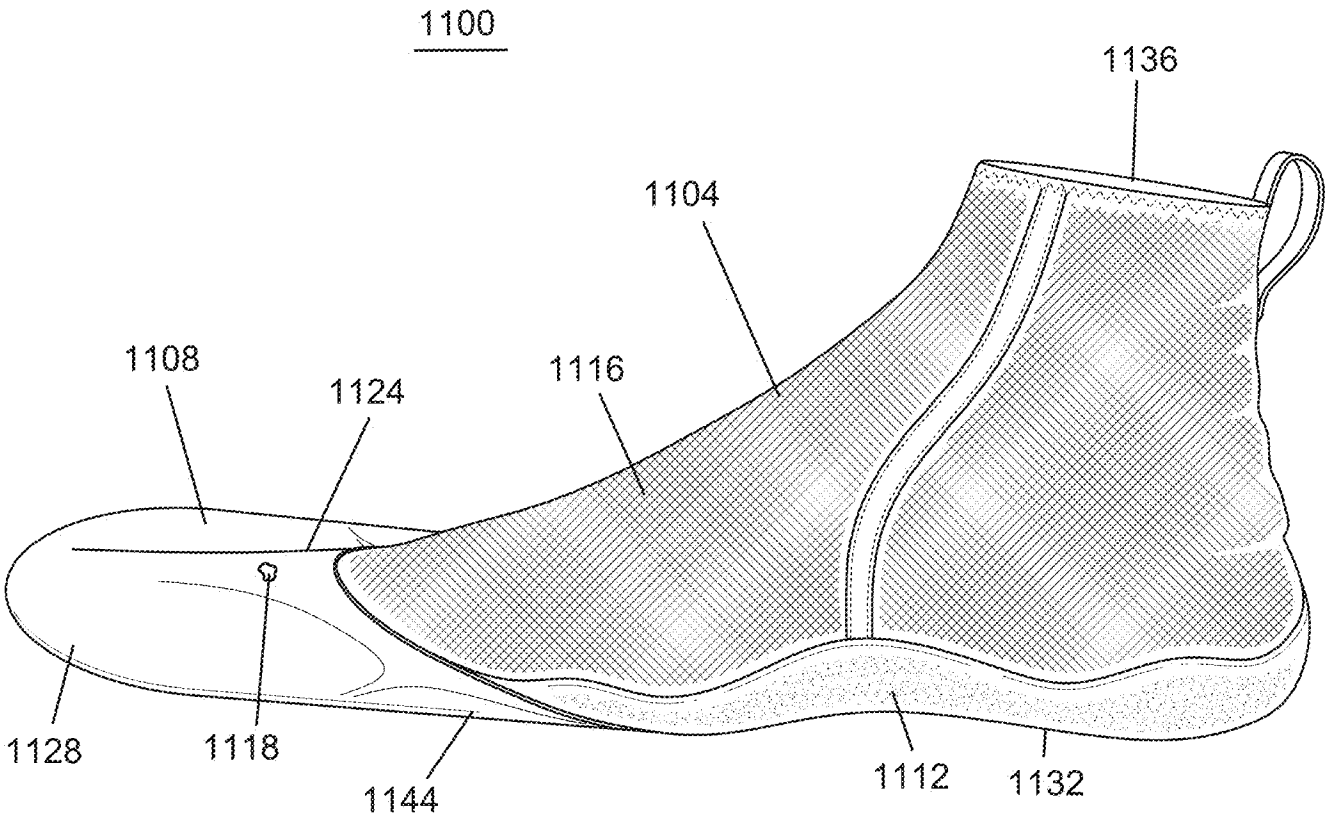
FIG. 12 shows a side view of an exemplary aquatic sock in conjunction with a finned support structure having a midsole structure.

FIGS. 11 and 12 show an embodiment of an aquatic footwear, or, more particularly, a sock or an aquatic sock 1100. The aquatic sock 1100 includes a sock portion 1104, a fin portion 1108, and a midsole structure 1112, as shown. The aquatic sock 1100 is formed by an assembly of the sock portion 1104, the fin portion 1108, and the midsole structure 1112. An application area of the aquatic sock 1100 can remain same and/or similar as has been described in relation to the various aquatic footwear embodiments discussed above.

The sock portion 1104 is configured to receive a user's foot and thus may serve as a foot enclosure portion for the aquatic sock 1100. The sock portion 1104 defines a main body portion 1116 to cover a majority of the user's foot (also optionally a part of the user's leg and/or calf portion). More particularly, the main body portion 1116 is configured to cover an ankle portion of the user, a bridge portion of the user, and toes of the user, where the bridge portion extends between the ankle portion and the toes.

Apart from the main body portion 1116, the sock portion 1104 includes a front foot portion 1118. The front foot portion 1118 (marked through a cutout in FIGS. 11 and 12) extends forwardly relative to the main body portion 1116 and accommodates or covers toes of a user's foot when the aquatic sock 1100 is worn over the foot of the user. In an assembly of the sock portion 1104 with the fin portion 1108, the front foot portion 1118 of the sock portion 1104 is inserted into the fin portion 1108 and thus may not be visible when the aquatic sock 1100 is worn. Nevertheless, the front foot portion 1118 is visualizable in the FIGS. 11 and 12 as the front foot portion 1118 corresponds to a part of the sock portion 1104 that is inserted into the fin portion 1108.

The sock portion 1104 may also define a mouth 1136 to receive the user's foot therein. A reception of the user's foot into the sock portion 1104 (e.g., through the mouth 1136) allows for an accommodation of the user's foot into the main body portion 1116 of the sock portion 1104 and further into the front foot portion 1118 of the sock portion 1104. The sock portion 1104 can be elastically formfitting and includes a non-cellular rubber. The sock portion 1104 further defines an underside surface 1120, as shown in FIG. 11. Although not limited, the underside surface 1120 may extend, at least partially, across each of the main body portion 1116 and the front foot portion 1118.

Although not limited, the sock portion 1104 may be formed from a flexible and/or a stretchable material and may include materials, such as spandex or neoprene or both, allowing flexibility in wearing and easy insertion and accommodation of the user's foot into the sock portion 1104 when applied to cover the user's foot with the sock portion 1104. In some embodiments, the sock portion 1104 is made from one or more layers of supple, pliant, form-fitting material. In yet some embodiments of the present disclosure, a material of the sock portion 1104 is selected from a group consisting of neoprene, Lycra, spandex, nylon, polyester, and silicone rubber. In some examples, the sock portion 1104 includes an outsole and/or a midsole (not shown).

The fin portion 1108 is partly slidable over and/or onto the front foot portion 1118 of the sock portion 1104, i.e., the part of the sock portion 1104 that receives the user's toes. To this end, the fin portion 1108 includes a toe enclosure section 1124 to receive said front foot portion 1118 of the sock portion 1102. Further, the fin portion 1108 includes one or more fins (e.g., see fin 1128) that extends forwardly and/or outwardly away from the toe enclosure section 1124. In some embodiments, the fin 1128 includes a structure that diverges outwardly and/or away from the toe enclosure section 1124 and which helps the user vary the efficiency with which a paddling and/or a swimming may be performed through water during use and/or during an application of the aquatic sock 1100. In some embodiments, the fin portion 1108 is made from a relatively rigid and yielding material.

The midsole structure 1112 is positionable under the sock portion 1104 and may also define a sole of the aquatic sock 1100. The midsole structure 1112 may define a receiving surface (not shown) for allowing the sock portion 1104 to be received and rested atop the midsole structure. In so doing, the fin portion 1108 can be adhered to the sock portion 1104. An adhering can be attained by use of suitable adhesives. To this end, in an assembly of the sock portion 1104 and the midsole structure 1112, the receiving surface of the midsole structure 1112 may abut and adhere (e.g., by use of suitable adhesives) against the underside surface 1120 of the sock portion 1104. Also, the midsole structure 1112 may be coupled, e.g., fixedly coupled to the sock portion 1104, e.g., to the underside surface 1120 of the sock portion 1104, as shown in FIG. 12. Opposite to the receiving surface, the midsole structure 1112 can define a surface of the sole (referred to as a lower sole surface 1132). In some embodiments, the lower sole surface 1132 can include an abrasive surface and/or a textured surface. As with the fin portion 1108, in some embodiments, the midsole structure 1112 is also made from a relatively rigid and yielding material.

According to an aspect of the present disclosure, the midsole structure 1112 and the fin portion 1108 are coupled (e.g., fixedly) to each other. For example, the midsole structure 1112 and the fin portion 1108 are integrally formed. To this end, the integral formation of the midsole structure 1112 and the fin portion 1108 may be attained by casting a suitable material and/or a combination of suitable materials into the same mold, thus forming a unitary structure (or a finned support structure 1144) (see FIG. 12) for the aquatic sock 1100. The finned support structure 1144, thus formed, may be inclusive of both the fin portion 1108 and the midsole structure 1112.

An exemplary method of manufacturing the aquatic sock 1100 is described further below in the present disclosure. In some embodiments, the midsole structure 1112 and/or the one or more fins (e.g., see fin 1128) of the fin portion 1108 may widen and/or define an increased thickness or width towards a front (e.g., further forwardly from the front foot portion 1118) of the aquatic sock 1100 to provide stability and/or flexibility of movement during application. As an example, the width may increase from a 3 millimeters (mm) flipper gradually to a 5 mm flipper.

Example Foot Enclosure Manufacturing Method

Known processes for manufacturing silicone or other rubber gloves can be adapted for use in manufacturing certain embodiments of sock-like foot enclosures.

Raw Material Preparation

The first step involves preparing the raw silicone rubber. The raw rubber is weighed and mixed according to the production requirements. Color blending is carried out based on customer specifications. This ensures that the silicone rubber has the desired properties and appearance.

Mold Preparation

A mold shaped like a foot or sock is prepared. This mold is typically made from ceramic or metal and is designed to replicate the anatomical features of a foot. The mold is cleaned thoroughly to remove any residues that could affect the quality of the final product.

Dipping Process

The cleaned mold is dipped into a silicone rubber solution. This solution is usually a high-purity, two-component platinum-cured silicone reinforced with specially treated silica. The dipping process coats the mold with a uniform layer of silicone rubber. The mold may be dipped multiple times to achieve the desired thickness.

Vulcanization

After dipping, the mold is placed in a heated chamber to vulcanize the silicone rubber. Vulcanization involves curing the silicone rubber at elevated temperatures, typically around 150-200° C. This process cross-links the silicone molecules, giving the rubber its final elastic and durable properties.

Cooling and Demolding

Once vulcanization is complete, the mold is allowed to cool. The silicone rubber sock is then carefully removed from the mold. This step requires precision to ensure that the sock retains its shape and does not tear.

In addition to silicone rubber, several alternative materials can be used to manufacture a sock-like foot enclosure, drawing inspiration from the materials used in gloves. These alternatives offer various benefits in terms of cost, performance, and environmental impact.

Thermoplastic Elastomers (TPE)

Thermoplastic elastomers (TPE) are a versatile material that combines the properties of rubber and plastic. TPEs offer flexibility, durability, and resistance to environmental factors, making them suitable for aquatic footwear. They can be molded into various shapes and provide a comfortable fit similar to silicone.

EPDM Rubber (Ethylene Propylene Diene Monomer)

EPDM rubber is a synthetic material known for its excellent resistance to heat, ozone, and weathering. It is commonly used in automotive and outdoor applications. EPDM rubber is a cost-effective alternative to silicone, offering durability and flexibility without the premium price.

Nitrile Rubber (NBR)

Nitrile rubber is another synthetic material that provides good resistance to oils, fuels, and chemicals. It is often used in gloves for industrial applications. NBR can be used to create a foot enclosure that is both durable and comfortable, suitable for various aquatic activities.

Neoprene

Neoprene is a synthetic rubber that offers excellent flexibility and insulation properties. It is widely used in wetsuits and aquatic gear. Neoprene can be used to manufacture a foot enclosure that provides warmth and comfort, making it ideal for cold-water swimming.

Plant-Based Alternatives

Plant-based materials, such as those derived from castor oil or starches, offer a sustainable and eco-friendly option. These materials can be used to create flexible and durable foot enclosures that reduce environmental impact. Plant-based alternatives are gaining popularity in various industries for their biodegradability and renewable nature.

Polyurethane (PU)

Polyurethane is a versatile material that can be used to create lightweight and durable foot enclosures. PU offers good flexibility and resistance to abrasion, making it suitable for aquatic footwear. It can be molded into various shapes and provides a comfortable fit.

Latex

Latex is a natural rubber material that offers excellent elasticity and comfort. It is commonly used in gloves and can be adapted for use in foot enclosures. Latex provides a snug fit and is suitable for various aquatic activities.

It is to be understood that the item of aquatic footwear and portions thereof shown in the Figures are representative embodiments, and the size and shape of the item and portions thereof may vary.

A foot enclosure portion and/or the fin portion can have different zones, e.g., stretch zone an inelastic zone, cushion, or comfort zone, a durability zone, a breathable zone, etc. For example, the underfoot side of a foot enclosure could have a rubbery or other rubbery polymer material for traction, protection, and durability. Top and sides of the foot enclosure could be elastic to conform to the foot and for comfort. The top and sides could include inelastic materials or structures for support or durability, etc. For example, one or more vertical bands that are disposed along a side of the foot enclosure and spanning from the height of the side could help support a foot. A horizontal band or cuff could span the sides and rear ankle area above the top of opening for support.

To provide certain functional or aesthetic attributes to the foot enclosure, a thermoplastic elastomeric material optionally may be heat fused or otherwise applied to selected areas of the base fabric for the sock or other portion of the garment. It may be applied to the inside and/or outside of the foot enclosure or fin portion. For example, it may be applied in a continuous coating or pattern (e.g., a pattern of spaced-apart elements like dots) to a bottom (underfoot) side of the sock (sole portion) to provide outsole functions. On the foot-facing and foot-contacting surface of the sole portion, the elastomeric material may be provided in a pattern and locations that provide anti-slip functions for the foot so that the foot enclosure does not shift on the foot during activities. Side(s) portions of the foot enclosure may also be coated or patterned with elastomeric material to provide grip, structural reinforcement, and/or aesthetic effects. The foot-facing side of the foot enclosure may also have a pattern of elastomeric material that is grippy and anti-slip so the upper does not shift on the user's foot.

The elastomeric material may be applied in thin layers that allow the foot enclosure to remain flexible and follow the contours of the foot. The material may be applied in a liquid or solid phase. Example thermoplastic polymer materials include polyurethane, nylon, polyester, polyethylene, neoprene, and polyolefin. Liquid silicone rubbers although they may not technically be a thermoplastic elastomer may be considered as such for purposes of the inventive subject matter. The material may adhere to the surface of base material for the foot enclosure or other material and/or infuse into the base fabric or other base foot enclosure material.

In constructing an item of footwear according to the inventive subject matter, patterns and shapes of the elastomeric or other polymeric material may be defined in molds with defined patterns or shapes on sheet materials, which are die cut, laser cut, manually cut, etc.

The processing of liquid materials into a pattern or shape may be by direct application to a base textile or by first forming the pattern or shape and then applying the part to the base material. Various techniques are known for fusing thermoplastic materials to textiles, including heat sealing, high frequency welding, injection molding, heat/pressure molding, laser welding, impulse welding, and ultrasonic welding.

If the foot enclosure is formed of multiple elements, the elements may be joined through, for example, stitching, adhesives, bonding, and/or thermobonding. Some or all the body of the foot enclosure may be a unitary, seamless construction based on known weaving, or knitting techniques for producing three-dimensional configurations or based on molding or thermobonding methods that leave no discernible seam.

In certain embodiments, the foot enclosure is formed of one or more panels or layers of pliant material that extend coplanarly around the parts of the body they surround. In such an embodiment, multiple panels can be joined edge-to-edge to create a coplanar outer surface construction across multiple body regions, e.g., the front and rear pelvic regions. In other embodiments, a single sheet or ply of pliant material surrounds such multiple body regions in a seamless construction. Any given panel can be made of single ply of material or multiple plies that are laminated together, e.g., a laminate of a durable outer material and an inner comfort liner. In other cases, a ply in the laminate could be a waterproof/breathable layer like a membrane of ePTFE.

Any textile elements used to form any portion of an item of aquatic footwear may be formed from any combination of 2-way or 4-way stretch textiles or non-stretch textiles. The 2-way stretch textiles may be configured into the garment to provide horizontal or vertical preferential directions of stretch. The 4-way stretch textiles may provide both vertical and horizontal directions of stretch. In addition to stretch materials that are made with elastic fibers, stretch may also be provided by fabrics constructed with inelastic fibers but formed in manner that provides mechanical stretch. For example, various known knit constructions can provide elastic stretch.

Although non-stretch textile elements may be used in the aquatic footwear, an advantage to stretch textile elements is that portions of regions of the footwear will selectively, resiliently stretch or otherwise elongate to conform to the user's anatomy during activities, thereby providing less restriction and a greater freedom of movement.

The elastic limit of elastic textiles or other sheet materials can vary based on the specific material and its composition. As used herein, elastic means that it has 50% or greater elongation before breakage, and inelastic means under 50% elongation before breakage. Accordingly, elastic materials may have an elastic limit of 50%, 75%, 100%, 150%, 200%, 300% or higher.

In continuation with the above discussion, one or more of which are associated with the making and/or the manufacturing of the aquatic footwears 1, 101, 201, 301, 401, 501, 601, 701 described above, and referring to further below, an exemplary method of manufacturing the aquatic sock 1100 is described. The method is described in conjunction with FIGS. 11 and 12.

The method includes forming the sock portion 1104 from a flexible and/or a stretchable material. As noted above, the flexible and/or the stretchable material can include spandex or neoprene or both. Also, a forming of the sock portion 1104 can include one or more stages in which one or more conventional or known methods are applied. In addition to the same, the method also includes forming the finned support structure 1144 for the sock portion 1104. As described above, the finned support structure 1144 includes the fin portion 1108 and the midsole structure 1112. The fin portion 1108 and the midsole structure 1112 can be integrally formed with each other to form the finned support structure 1144, and therefore, forming the finned support structure 1144 can include the casting of a suitable material and/or a combination of suitable materials in a single mold (not shown).

Once the finned support structure 1144 is formed, the method includes inserting the front foot portion 1118 of the sock portion 1104 into the toe enclosure section 1124 of the fin portion 1108. Additionally, or optionally, the method includes attaching the front foot portion 1118 of the sock portion 1104 to the toe enclosure section 1124 of the fin portion 1108. As an example, the fin portion 1108 is attached to the sock portion 1104 by co-molding or thermobonding. Additionally, or optionally, the attachment between the front foot portion 1118 of the sock portion 1104 and the toe enclosure section 1124 of the fin portion 1108 can include the use of adhesives, and the like. In some embodiments, however, the fin portion 1108 is attached to the sock portion 1104 by mechanical means selected from a group consisting of straps, ratchet systems, buckles, Velcro, snap buttons, and zippers.

The method further includes the attaching and/or the coupling of the receiving surface of the midsole structure 1112 with the underside surface 1120 (see FIG. 11) of the sock portion 1104. As an example, the receiving surface is coupled and/or adhered to the underside surface 1120 of the sock portion 1104 by co-molding or thermobonding. Additionally, or optionally, the attachment or coupling between the receiving surface and the underside surface 1120 can include the use of adhesives, and the like.

FIG. 6 is an anatomical mapping of the foot. The "forefoot" F includes the toes 122, 123 and metatarsals, and it provides the ground contact area of the ball of the foot. It consists of most of the bony architecture of the foot including phalanges to the toes, five metatarsal bones and the two sesamoid bones of the big toe joint. It includes the ball of the foot which is generally at the joint 120 formed at the base of the proximal phalanges and the heads of the metatarsals. The "midfoot" M is the intersection between the forefoot and rearfoot. Its anatomic location is at the peak or highest part of the arch and has important joints connecting it to the forefoot and the rearfoot region. It consists of five bones including three cuneiform bones, and the navicular and cuboid bones. The "rearfoot" R connects to the midfoot and to the ankle and provides the ground contact area of the heel region of the foot. It consists of the bony architecture of the calcaneus 118 and talus. Accordingly, in the inventive subject matter, the "forefoot region" of aquatic footwear refers generally to a portion of the footwear receiving the toes and some or all the metatarsals of the foot of a wearer. The "midfoot region" of the compartment refers generally to a portion of the compartment receiving the arch of the foot of a wearer. The "rearfoot region" of the compartment refers generally to a portion of the compartment receiving the heel of the wearer.

A foot enclosure portion would typically enclose or correspond to at least the midfoot and rearfoot areas of a user's foot. It may also enclose or correspond to some or all the forefoot area. In some embodiments, the fin portion may have a section that encloses or corresponds to some or all the forefoot area of a user's foot.

Persons skilled in the art will recognize that many modifications and variations are possible in the details, materials, and arrangements of the parts and actions which have been described and illustrated to explain the nature of the inventive subject matter, and that such modifications and variations do not depart from the spirit and scope of the teachings and claims contained therein.

Any patent and non-patent literature cited herein is hereby incorporated by references in its entirety for all purposes.

The principles described above about any particular example can be combined with the principles described regarding any one or more of the other examples. The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein but are to be accorded the full scope consistent with the language of the claims, wherein reference to an element in the singular, such as by use of the article "a" or "an" is not intended to mean "one and only one" unless specifically so stated, but rather "one or more". As used herein, "and/or" means "and" or "or", as well as "and" and "or."

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law unless the element is expressly recited using the phrase "means for" or "step for".

The inventor reserves the right to claim, without limitation, at least the following subject matter.

What is claimed is:

1. A sock comprising:

a sock portion defining a main body portion and a front foot portion integrally extending from the main body portion, the front foot portion configured to accommodate and cover toes of a user's foot;

a fin portion defining a toe enclosure section to slidably receive the front foot portion of the sock portion and defining one or more fins extending forwardly and outwardly away from the toe enclosure section;

a midsole structure fixedly coupled to the fin portion and defining a surface adhered to an underside surface of the sock portion; and one or more tensile elements structurally interconnecting the fin portion and the sock portion, one or more tensile elements structurally interconnecting the fin portion and the sock portion, wherein each tensile element is fixedly anchored at a first end to the fin portion and at a second end to the sock portion, wherein the tensile elements extend along at least one lateral side of the sock portion and loop around a heel region, and wherein the tensile elements transmit propulsive forces from the fin portion to the sock portion to stabilize the sock portion during swimming, and are structurally integrated with the sock portion.

2. The sock of claim 1, wherein the midsole structure and the fin portion are integrally formed with each other.

3. The sock of claim 1, wherein the sock portion is made from one or more layers of elastically deformable during donning elastically stretchable and configured to conform to foot anatomy, and the fin portion is made from a polymeric material configured to generate propulsion during swimming.

4. The sock of claim 1, wherein the fin portion is adhered to the sock portion by use of adhesives.

5. The sock of claim 1, wherein the main body portion is configured to cover an ankle portion of the user, a bridge portion of the user, and toes of the user, the bridge portion extending between the ankle portion and the toes.

6. The sock of claim 1, wherein the sock portion is elastically formfitting and includes a non-cellular rubber.

7. The sock of claim 1, wherein a material of the sock portion is selected from a group consisting of neoprene, Lycra, spandex, nylon, polyester, and silicone rubber.

8. The sock of claim 1, wherein the fin portion is attached to the sock portion by co-molding or thermobonding.

9. The sock of claim 1, wherein the fin portion is attached to the sock portion by mechanical means selected from a group consisting of straps, ratchet systems, buckles, Velcro, snap buttons, and zippers.

10. A method of manufacturing an aquatic sock, the method including:

forming a sock portion from a flexible and/or a stretchable material to cover a foot of a user, the sock portion defining an underside surface, a main body portion and a front foot portion integrally extending from the main body portion, the front foot portion configured to accommodate and cover toes of a user's foot, the main body portion is configured to cover an ankle portion of the user, a bridge portion of the user, and toes of the user, the bridge portion extending between the ankle portion and the toes; and forming a finned support structure for the sock portion, the finned support structure including a fin portion and a midsole structure integrally formed with each other, the midsole structure defining a receiving surface;

inserting the front foot portion of the sock portion into a toe enclosure section of the fin portion and attaching the front foot portion to the toe enclosure section of the fin portion; and coupling:

the underside surface with the receiving surface of the midsole structure; and one or more tensile elements to structurally interconnect the fin portion and the sock portion, wherein each tensile element is anchored to both the fin portion and the sock portion and transmits propulsive forces from the fin portion to the sock portion.

11. The method of claim 10, wherein the midsole structure and the fin portion are integrally formed with each other.

12. The method of claim 10, wherein the sock portion is made from one or more layers of elastically deformable during donning elastically stretchable and configured to conform to foot anatomy, and the fin portion is made from a polymeric material configured to generate propulsion during swimming.

13. The method of claim 10, wherein the fin portion is adhered to the sock portion by use of adhesives.

14. The method of claim 10, wherein the sock portion is elastically formfitting and includes a non-cellular rubber.

15. The method of claim 10, wherein a material of the sock portion is selected from a group consisting of neoprene, Lycra, spandex, nylon, polyester, and silicone rubber.

16. The method of claim 10, wherein the fin portion is attached to the sock portion by co-molding or thermobonding.

17. The method of claim 10, wherein the fin portion is attached to the sock portion by mechanical means selected from a group consisting of straps, ratchet systems, buckles, Velcro, snap buttons, and zippers.

* * * * *